United States Patent [19]

Bacskai et al.

[11] Patent Number: 4,780,278

[45] Date of Patent: Oct. 25, 1988

[54] ALKYLANILINE/FORMALDEHYDE OLIGOMERS AS CORROSION INHIBITORS

[75] Inventors: Robert Bacskai, Kensington; Albert H. Schroeder, Richmond, both of Calif.

[73] Assignee: Chevron Research Company, San Francisco, Calif.

[21] Appl. No.: 926,036

[22] Filed: Oct. 31, 1986

[51] Int. Cl.[4] ..... C23F 11/00; C23F 11/04

[52] U.S. Cl. ..... 422/7; 252/8.555; 252/390; 252/391; 252/393; 422/16; 528/129; 528/137

[58] Field of Search ..... 252/8.555, 390, 391, 252/393; 422/7, 16; 528/137, 129, 162

[56] References Cited

U.S. PATENT DOCUMENTS

| | | | |
|---|---|---|---|
| 2,882,171 | 4/1959 | Denman | 106/14.13 |
| 2,889,277 | 6/1959 | Hughes | 252/8.555 |
| 3,959,158 | 5/1976 | Stanford et al. | 252/8.555 |
| 4,454,298 | 6/1984 | Koyama et al. | 528/137 |
| 4,529,682 | 7/1985 | Toukhy | 528/162 |
| 4,555,544 | 11/1985 | Meyer et al. | 528/137 |

FOREIGN PATENT DOCUMENTS 0001086 2/1984 PCT Int'l Appl. .

*Primary Examiner*—Paul Lieberman
*Assistant Examiner*—Ronald A. Krasnow
*Attorney, Agent, or Firm*—S. R. La Paglia; R. C. Gaffney; C. J. Caroli

[57] ABSTRACT

A hydrocarbon-soluble corrosion inhibitor composition comprising the reaction product obtained by the acid-catalyzed oligomerization of an alkylaniline and formaldehyde, wherein the alkylaniline has from 4 to 30 carbon atoms in the alkyl substituent. Also disclosed is a method of inhibiting corrosion of a corrodible metal utilizing said composition.

16 Claims, No Drawings

ALKYLANILINE/FORMALDEHYDE OLIGOMERS AS CORROSION INHIBITORS

BACKGROUND OF THE INVENTION

This invention relates to a hydrocarbon-soluble composition which is useful in inhibiting the corrosion of a corrodible metal material. More particularly, this invention relates to a hydrocarbon-soluble composition comprising the reaction product obtained by the acid-catalyzed oligomerization of an alkylaniline and formaldehyde. The invention further relates to a method of inhibiting corrosion in corrodible metals.

Corrosion inhibition in acid systems has been the subject of considerable interest in recent years. In industrial cleaning operations, where aqueous solutions of acid serve to remove scale and other deposits from metallic surfaces of industrial equipment, the inhibitors are used to reduce acid attack on the metals of construction during the cleaning operations. In processing operations where some acid is present or may be generated, inhibitors are introduced to reduce the corrosiveness of the acid. In oil well operations, corrosion inhibitors are introduced during various treatment stages and during secondary recovery operations. In all these operations, the corrosion inhibitor is in a form which is dispersible and preferably miscible in the liquid medium of the particular system.

Since the industrial equipment being protected by the inhibitor is often of considerable value or is often difficult and expensive to replace, significant importance has been given to the development of new and improved corrosion inhibitors. One area of such interest has been the organic inhibitors such as the amines, ketones, sulfides, acetylenic alcohols and the like. In respect to the amines or to their acid salts commonly formed in the acidic systems, fatty amines having one or more amine groups have been recognized as effective inhibitors. Rosin amines have also been used as corrosion inhibitors as have their oxyalkylated derivatives. In addition, various polymeric resins with amine functionalities have been used to some extent.

U.S. Pat. No. 3,770,377 discloses a method for preventing corrosion of metals by an acidic environment by utilizing a corrosion inhibitor which is the reaction product formed by reacting, in the liquid phase and under neutral conditions, at least one carbonyl compound and at least one amine containing a plurality of primary or secondary amino grups. Specific amines taught by this patent include hexamethylene diamine and 1,8-diaminonaphthalene. Specific carbonyl compounds employed include formaldehyde and cyclohexanone.

U.S. Pat. No. 4,554,090 discloses a combination corrosion and scale inhibitor composition comprising the reaction product of (a) a heterocyclic nitrogen containing compound selected from alkylpyridine, alkylpyrimidine, alkylimidazole, alkylimidazoline, quinoline and quinaldine, (b) an aldehyde and (c) a phosphoric acid constituent.

U.S. Pat. No. 3,977,981 discloses a method for inhibiting corrosion of corrodible metals utilizing a 14-membered or 16-membered macrocyclic tetramine.

U.S. Pat. No. 4,511,480 discloses a method of inhibiting corrosion of ferrous metals by employing a phosphate ester of an oxyalkylated thiol.

U.S. Pat. No. 4,089,789 discloses a method for inhibiting corrosion of ferrous metal in an acid system utilizing an oxyalkylated phenolic inhibitor comprising the reaction product of (a) an alkylene oxide and (b) a phenolic compound having two non-oxyalkylatable, saturated tertiaryamino alkylene groups.

SUMMARY OF THE INVENTION

The present invention provides a hydrocarbon-soluble corrosion inhibitor composition comprising the reaction product obtained by the acid-catalyzed oligomerization of (a) an alkylaniline having from 4 to 30 carbon atoms in the alkyl substituent, and (b) formaldehyde.

The present invention further provides a method of inhibiting corrosion of a corrodible metal material which comprises contacting the metal material with an effective amount of the corrosion inhibitor composition of the invention.

The present invention is also concerned with a method of inhibiting corrosion of a corrodible metal material in or around a well through which a corrosive fluid is produced, which comprises contacting the metal material with an effective amount of the corrosion inhibitor composition of the invention.

Among other factors, the present invention is based on the discovery that the oligomeric polyamines obtained by the acid-catalyzed oligomerization of certain alkylanilines and formaldehyde are excellent corrosion inhibitors in various environments. More particularly, the invention is based, in part, on the discovery that the presently described oligomers exhibit very good initial inhibition of metal corrosion in aqueous environments and this effect is surprisingly much more persistent than that observed for the corresponding monoamine starting material. Moreover, in an acidic environment, the oligomeric products of this invention show superior persistence in inhibiting corrosion when compared with known monoamine corrosion inhibitors, such as tallow amine. Advantageously, the present oligomers can be formulated to be both hydrocarbon-soluble and water dispersible.

DETAILED DESCRIPTION OF THE INVENTION

The alkylaniline/formaldehyde oligomeric reaction products of the invention are prepared by the reaction of an alkylaniline with formaldehyde in the presence of an acid catalyst. In general, the alkyl side chain on the alkylaniline will contain from about 4 to 30 carbon atoms, preferably from 10 to 30 carbon atoms, and more preferably, from 12 to 24 carbon atoms. Examples of preferred alkylanilines include dodecylaniline and ($C_{20-24}$)-alkylaniline. The average molecular weight of the oligomeric reaction product will normally be in the range of about 500 to 10,000, preferably in the range of about 800 to 7,000.

The alkylaniline starting material may be prepared from readily available alkylaromatic feedstocks. These alkylaromatic feedstocks are commonly obtained by the reaction of a suitable olefin with benzene. The olefins which are suitable for this reaction may be either straight chain, slightly branched or highly branched in structure. Straight chain olefins are normally obtained by the cracking of wax or from the ethylene growth reaction. Branched chain olefins are conveniently obtained by the polymerization of lower molecular weight olefins, such as propylene or isobutylene. The olefins which are particularly useful for preparing the alkylaromatic feedstocks are those having from 4 to 30 carbon atoms, preferably from 10 to 30 carbon atoms, and more preferably, from 12 to 24 carbon atoms. The alkylaromatic feedstocks are commercially available as detergent precursors.

The alkylbenzene compounds are then mononitrated with a nitric acid/sulfuric acid mixture, using conventional methods. The mononitrated alkylbenzene is subsequently reduced to the corresponding alkylaniline by catalytic hydrogenation, using procedures well known to the art.

Alternatively, the alkylaniline starting material may be prepared by the alkylation of aniline with an olefin, as disclosed in commonly assigned, copending U.S. patent application, Ser. No. 925,198, filed concurrently herewith, titled "Process for the Preparation of Alkylaniline Using a Friedel-Crafts Catalyst." According to this procedure, the desired alkylaniline is obtained by reacting aniline with an appropriate olefin in the presence of a Friedel-Crafts catalyst. Suitable Friedel-Crafts catalysts include aluminum chloride, boron trifluoride, boron trifluoride-etherate, boron trichloride, aluminum bromide, and the like. The preferred Friedel-Crafts catalyst is aluminum chloride. The amount of catalyst utilized will generally range from about 0.1 to 10 weight percent.

Suitable olefins for reaction with aniline may be either straight chain or branched chain in structure and are generally obtained by conventional procedures, such as wax cracking, the ethylene growth reaction and the polymerization of lower molecular weight olefins. Preferred olefins for reaction with aniline will normally contain about 10 to 30 carbon atoms. The molar ratio of olefin to aniline will normally range from about 1:10 to 10:1.

The Friedel-Crafts catalyzed reaction of aniline with an appropriate olefin will generally take place in a pressure reactor at a pressure in the range of about 40 psi to 500 psi. The reaction temperature will generally range from about 150° C. to about 350° C. The reaction will normally proceed over a period of about 0.5 to 8 hours. The resulting alkylaniline is then separated from the catalyst residue and unreacted starting materials, using conventional techniques.

A further alternative for preparing the alkylaniline starting material is by the alkylation of aniline with an olefin, as disclosed in commonly assigned, copending U.S. patent application Ser. No. 925,335, filed concurrently herewith, titled "Process For the Preparation of Alkylaniline Using an Aluminosilicate Catalyst." According to this procedure, the reaction of aniline with an olefin is carried out in the presence of an aluminosilicate catalyst. The aluminosilicate catalyst may be any of the well-known aluminosilicates, such as the crystalline aluminosilicate zeolites and the various aluminosilicate clays. In general, the aluminosilicates which are suitable for use in this process are those having a silica to alumina molar ratio in the range of about 3:1 to about 150:1, preferably in the range of about 3:1 to 6:1. The amount of catalyst utilized will generally range from about 0.1 weight percent to about 20 weight percent.

Suitable aluminosilicate catalysts include the aluminosilicate zeolites, which are generally employed as hydrated silicates of aluminum and either sodium or calcium, or both. The zeolite catalyst may be a natural zeolite or an artificial ion exchange resin. Typical zeolite catalysts which are useful for this process include the ZSM-5 type of zeolite catalyst, available from Mobil Chemical Company. ZSM-5 is a crystalline aluminosilicate zeolite having intermediate pore sizes. Other zeolites of the ZSM-5 type are also contemplated, such as ZSM-11. Other zeolite catalysts which may be employed include Linde LZY-20, available from Union Carbide, which is a crystalline aluminosilicate having a unit cell size of 24.37 Angstroms and a silica to alumina molar ratio of 5.6:1, Linde LZY-82, which is a crystalline aluminosilicate having a unit cell size of 24.56 Angstroms and a silica to alumina molar ratio of 5.4:1, and Linde SK-500, which is a crystalline aluminosilicate having a silica to alumina molar ratio of 4.9:1.

The aluminosilicate catalyst may also be any of the commercially available natural clays, which are generally hydrated aluminum silicates having a very fine particle size of irregularly shaped crystals. Typical clays which are useful as catalysts in this process include kaolin, montmorillonite, attapulgite, illite, bentonite, halloysite and mullite. A particularly suitable clay catalyst is Filtrol Grade 22 clay, available from Filtrol Corp., which is an aluminosilicate clay characterized as a highly activated adsorbent used for the low temperature decolorization of animal, vegetable and mineral oils.

The aluminosilicate catalyzed alkylation reaction will generally employ the same starting materials and can be carried out under the same reaction conditions as described above for the Friedel-Crafts catalyzed reaction of aniline and an olefin.

The alkylaniline produced by either the Friedel-Crafts or aluminosilicate catalyzed reaction of aniline with an olefin will normally contain a mixture of isomers, including ortho-, para- and N-substituted alkylaniline. In general, the ortho-substituted alkylaniline will be the predominant isomer.

The formaldehyde starting material is commercially available in three forms, namely, as an aqueous solution, as solid trioxane, and as solid paraformaldehyde. Although all three types of formaldehyde may be utilized in preparing the present oligomers, it is preferred to use aqueous formaldehyde.

The alkylaniline and formaldehyde are oligomerized using an acid catalyst, in a manner similar to the known acid-catalyzed condensation reaction of phenol and formaldehyde. The reaction temperature will generally be in the range of about 50° C. to 120° C., preferably in the range of about 70° C. to 100° C. The reaction pressure is generally ambient. An acid catalyst, such as hydrogen chloride, sulfuric acid, phosphoric acid, and the like, is employed in amounts ranging from about 0.1 to 50 percent by weight of the total reaction mixture. The reaction time is generally from 0.5 to 6 hours.

The molar ratio of formaldehyde to alkylaniline will normally range from about 0.8:1 to 4:1, preferably from about 1:1 to 1.8:1. After completion of the reaction, the oligomer is normally isolated as a solid product.

For use as corrosion inhibitors, the hydrocarbon-soluble oligomeric reaction products of the invention are applied to the metal surfaces to be protected in a variety of ways known to the art. For example, a dilute hydrocarbon solution of the oligomer may be contacted with the metal to be protected, using methods such as dipping, spraying, wiping, and the like. For this method of application, solutions of about 0.1 to 10%, preferably from about 0.2 to 1%, by weight of oligomer, or mixture of oligomer and other active corrosion inhibiting agents, are employed. The hydrocarbon solvent may be any of the known solvents, such as kerosene, diesel fuel, paint thinner, toluene, lubricating oil, and similar materials.

Alternatively, water-dispersible formulations of the present oligomers, or mixtures of the oligomers and other active corrosion inhibiting agents, can be added to a corrosive aqueous environment. In this method of application, sufficient amounts of oligomer, or mixture of the oligomer and other active corrosion inhibiting agents, are added to give from about 1 to 1000 ppm, preferably from 10 to 500 ppm, of active corrosion inhibitor in the final solution. Generally, the oligomer will be combined with a solvent and a surface-active agent to produce a concentrated solution of the corrosion inhibitor. In this solution, the oligomer, or mixture of the oligomer and other active corrosion inhibiting agents, will be present in amounts ranging from about 10 to 60%, preferably about 30 to 50%, by weight. The amount of solvent present is from about 30 to 80%, and the amount of surfactant is about 1 to 20%, by weight. This concentrated formulation is then diluted to the desired concentration of the final solution.

A typical water-dispersible formulation will contain about 15 to 30% of the present oligomer, about 15 to 30% of a dimer/trimer acid, about 1 to 8% of a nonionic surfactant, about 40 to 75% of a hydrocarbon solvent, such as kerosene, and about 0 to 5% of isopropanol.

Water-dispersible formulations of the present hydrocarbon-soluble oligomers are particularly useful in brine/$CO_2$ environments, such as encountered in oil wells employing secondary oil recovery techniques.

It has been found that, in comparative experiments employing one molar aqueous hydrochloric acid on mild steel, the oligomeric compounds of the invention gave long-term inhibition of corrosion greatly in excess of that shown by the corresponding alkylaniline starting material. Thus, after 96 hours, the present oligomers were still providing over 95% inhibition of corrosion, whereas the corresponding alkylanilines provided essentially no inhibition after only 24 hours. Moreover, the oligomeric compounds of the invention have also been shown to be superior to the amine corrosion inhibitors of the prior art. For example, in an acid/mild steel test, the oligomeric inhibitors of the invention maintained a corrosion rate below 200 mils per year (mpy) for over 24 hours, whereas the rate of corrosion with a known tallow amine inhibitor was over 1000 mils per year after just 3 hours.

The following examples are provided to illustrate the invention in accordance with the principles of this invention but are not to be construed as limiting the invention in any way except as indicated by the appended claims.

EXAMPLES

Example 1

Preparation of Dodecylaniline/formaldehyde Oligomer

The dodecylaniline used in this example was 90–95% para-substituted dodecylaniline, obtained from Monsanto Company. The dodecyl side chain was a mixture of several isomers, derived from propylene tetramer.

To a 2-liter, 3-necked flask, equipped with a mechanical stirrer, condenser and thermometer, was added 261 g dodecyl-aniline (1.0M), 200 g water and 200 g concentrated HCl (2.1M). The mixture was stirred and 98 g of 37% formaldehyde (1.2M) was added in portions over a period of 15 minutes. The reaction mixture was stirred for 2 hours at room temperature, followed by 2 hours at 90°–100° C. The mixture was cooled to room temperature and was neutralized with 1828 g of 5% NaOH. The solid reaction product was separated from the liquids by decantation, washed with water and dissolved in methylene chloride. Evaporation of the methylene chloride gave 298.7 g of oligomer having a molecular weight of 1140, as determined by vapor pressure osmometry. Nitrogen analysis of the oligomer showed 4.67% nitrogen.

The $^1$H-NMR spectrum of the oligomer showed a broad, unresolved peak at 6.8–7.8 ppm (aromatic proton region). Completely absent from the oligomer spectrum were sharp peaks at 6.58, 6.60, 7.08 and 7.11 ppm, characteristic for the starting dodecylaniline. This indicated that the dodecylaniline had reacted completely to form the oligomer.

Infrared analysis of the oligomer showed a strong absorption in the 3395 and 3481 $cm^{-1}$ region, indicative of $—NH_2$ groups.

Examples 2–9

Additional alkylaniline/formaldehyde oligomers, with various alkyl side chains, were prepared using essentially the same reaction conditions as in Example 1. The results are summarized in Tables I and II.

TABLE I

| Preparation of Tridecylaniline[a]/Formaldehyde Oligomers | | | | | | | | | |
|---|---|---|---|---|---|---|---|---|---|
| Example | p-Tridecyl-Aniline | | Formaldehyde (37%) | | Formaldehyde: Alkylaniline | | Mol. | % | Soluble in |
| No. | Wt. g | Moles, M | Wt. g | Moles, M | Mole Ratio | Yield, g | Wt.[b] | Nitrogen | n-heptane |
| 2 | 14.0 | 0.05 | 6.5 | 0.08 | 1.6 | 19.7 | 900 | 4.0 | yes |
| 3 | 14.0 | 0.05 | 4.9 | 0.06 | 1.2 | 16.3 | 820 | 4.3 | yes |
| 4 | 14.0 | 0.05 | 4.1 | 0.05 | 1.0 | 15.7 | 870 | 4.2 | yes |

[a]Prepared from tridecylbenzene by nitration-hydrogenation. The tridecyl side chain is derived from propylene tetramer and is a mixture of several isomers.
[b]Vapor pressure osmometry (45° C., toluene)

TABLE II

| Preparation of Alkylaniline/Formaldehyde Oligomers | | | | | | | | | |
|---|---|---|---|---|---|---|---|---|---|
| Example | | | | Formaldehyde (37%) | | | Mol. | % | Soluble in |
| No. | Alkylaniline | Wt. g | Moles, M | Wt. g | Moles, M | Yield, g | Wt.[c] | Nitrogen | n-heptane |
| 5 | p-hexyl-aniline[a] | 9.1 | 0.05 | 6.5 | 0.08 | 10.4 | 940 | 6.3 | no (soluble in xylene) |

TABLE II-continued

| Example No. | Alkylaniline | Wt. g | Moles, M | Formaldehyde (37%) Wt. g | Moles, M | Yield, g | Mol. Wt.[c] | % Nitrogen | Soluble in n-heptane |
|---|---|---|---|---|---|---|---|---|---|
| | | Preparation of Alkylaniline/Formaldehyde Oligomers | | | | | | | |
| 6 | p-dodecyl-aniline[a] | 261 | 1.0 | 98 | 1.2 | 298.7 | 1140 | 4.7 | yes |
| 7 | p-tridecyl-aniline[a] | 14.0 | 0.05 | 6.5 | 0.08 | 19.7 | 900 | 4.0 | yes |
| 8 | p-octadecyl-aniline[a] | 17.0 | 0.05 | 6.5 | 0.08 | 18.7 | 730 | 3.1 | yes |
| 9 | p-dodecyl-aniline[b] | 140 | 0.54 | 70 | 0.86 | 145.2 | 700 | 4.5 | yes |

[a]Prepared from alkylbenzene by nitration-hydrogenation. The alkyl side chain is derived from propylene tetramer and is branched.
[b]Prepared from alkylbenzene by nitration-hydrogenation. The alkyl side chain is linear.
[c]Vapor pressure osmometry (45° C., toluene)

Example 10

Preparation of Dodecylaniline from Aniline and 1-Dodecene

A one-liter stainless steel autoclave was charged with 333 g (3.57M) aniline, 169 g (1.0M) 1-dodecene and 16.7 g anhydrous aluminum chloride. The autoclave was purged with nitrogen, then heated under nitrogen pressure (about 150 psi) at 250° C. and stirred for 3 hours. After cooling to room temperature, the reaction mixture was dissolved in 300 ml toluene, washed with 600 ml of 5% NaOH and twice with 600 ml water. Gas chromatographic analysis showed that the toluene solution contained 183.6 g (0.703M) dodecylaniline and 26.3 g (0.156M) dodecene. The toluene was evaporated and the residue was distilled under vacuum. The fraction boiling at 181° C./0.7 mm Hg was determined to be 99.1% dodecylaniline by gas chromatography.

Nitrogen analysis of the above distillate showed 5.41% nitrogen (theory=5.36%). Infrared analysis showed a strong absorption at 3400 and 3480 $cm^{-1}$, indicative of —$NH_2$ groups. $^{13}C$-NMR analysis showed the presence of 63% ortho-dodecylaniline, 7% para-dodecylaniline and 30% N-dodecylaniline.

Example 11

Preparation of ($C_{20-24}$)-alkylaniline

Following a procedure similar to Example 10, ($C_{20-24}$)-alkylaniline was prepared from aniline and a ($C_{20-24}$)-alpha-olefin. The alkylaniline product had a boiling point of 240°-252° C./0.5 mm Hg. Nitrogen analysis of this product showed 3.55% nitrogen (theory=3.65%).

Examples 12–15

Preparation of Alkylaniline/Formaldehyde Oligomers From Mixed Isomer Alkylanilines Dodecylaniline and ($C_{20-24}$)-alkylaniline, prepared from aniline and the corresponding alpha-olefin as described in Examples 10 and 11, were each reacted with formaldehyde to form alkylaniline/formaldehyde oligomers, using essentially the same reaction conditions as in Example 1. The results are shown in Table III.

The alkylanilines derived from aniline alkylation with alpha-olefins consisted of mixtures of ortho-, para- and N-substituted isomers, as compared to the predominantly para-substituted isomers produced from the nitration-hydrogenation of alkylbenzene. The molecular weight of the oligomers prepared from these mixed isomer alkylanilines (Table III) were significantly higher than the oligomers prepared from predominantly para-substituted alkylanilines (Tables I and II).

TABLE III

| Example No. | Mixed Isomer Alkyl-Aniline | Wt. g | Moles, M | Formaldehyde (37%) Wt. g | Moles, M | Yield, g | Mol. Wt.[b] | % Nitrogen | Solubility Xylene | Solubility n-heptane |
|---|---|---|---|---|---|---|---|---|---|---|
| | | Preparation of Alkylaniline/Formaldehyde Oligomers From Mixed Isomer Alkylaniline[a] | | | | | | | | |
| 12 | dodecyl-aniline | 26.1 | 0.1 | 8.2 | 0.1 | 30.5 | 6800 | 4.6 | yes | no |
| 13 | dodecyl-aniline | 26.1 | 0.1 | 9.7 | 0.12 | 30.1 | 6600 | 4.5 | yes | no |
| 14 | dodecyl-aniline | 51.4 | 0.2 | 26 | 0.32 | 60 | 2700 | 4.4 | yes | no |
| 15 | ($C_{20-24}$)—alkyl-aniline | 38.3 | 0.1 | 9.7 | 0.12 | 37.2 | 4200 | 3.1 | yes | no |

[a]Prepared from aniline and an alpha-olefin
[b]Vapor pressure osmometry (45° C., toluene)

Example 16

Corrosion Inhibitor Evaluation

Comparison of Monomeric and Oligomeric Alkylanilines for $CO_2$ Corrosion

Cleaned, sanded and degreased mild steel coupons were immersed in a 3% NaCl solution saturated with $CO_2$ gas at room temperature and equilibrated for 18 hours. The instantaneous general corrosion rates were electrochemically measured using the standard linear polarization method to give the uninhibited corrosion rates for the test coupons. The coupons were then removed from the aqueous corrosion solution and immersed in a 10-weight % solution of the amine to be tested in kerosene for one hour. The coupons were then rinsed in a pure kerosene solution for one hour, and then immersed again in the aqueous corrosion solution. Initial inhibited corrosion rates (CR) were measured using the linear polarization method 15 minutes after re-immersion in the 3% $NaCl/CO_2$ solution. The percent inhibition was then calculated as follows:

% Inhibition = (Uninhibited CR − Inhibited CR)/Uninhibited CR

Using the above procedure, para-dodecylaniline provided only 20% inhibition, whereas the p-dodecylaniline/formaldehyde oligomer of the invention (mol. wt. = 720, nitrogen analysis = 4.5% N, prepared using the procedure described in Example 1) provided 97% inhibition of the $CO_2$ corrosion.

Example 17

Comparison of Monomeric and Oligomeric Alkylanilines for HCl Corrosion

The same techniques for coating the coupons with inhibitor and measuring corrosion rates were used as in Example 16, except that the aqueous corrosion solution in this case was a 1 molar HCl solution purged with inert nitrogen gas at room temperature. In addition to measuring the initial inhibited corrosion rate, the inhibited corrosion rate was monitored as a function of time over the course of 96 hours to determine the film persistence of the amine inhibitor coating on the test coupon.

In this case, the initial corrosion rates measured 15 minutes after re-immersion in the HCl solution corresponded to greater than 99% inhibition for both the para-dodecylaniline and the p-dodecylaniline/formaldehyde oligomer of the invention (mol. wt. = 720, nitrogen analysis = 4.5% N, prepared using the procedure of Example 1). However, the persistence of the p-dodecylaniline film was relatively short, as evidenced by a decrease in the percent inhibition to zero over the course of 18 hours. In contrast, the p-dodecylaniline/formaldehyde oligomer film was still providing greater than 95% inhibition after 96 hours, when the test was terminated.

Example 18

Comparison of Oligomeric Alkylaniline With Tallowamine for HCl Corrosion

Cleaned, sanded and degreased mild steel coupons were immersed in a stirred 1 molar HCl solution purged with inert nitrogen gas at 90° C. and equilibrated for 15 minutes. The instantaneous general corrosion rates were electrochemically measured using the standard linear polarization method to give the uninhibited corrosion rates for the test coupons, typically above 10,000 mpy (mils per year) in this aggressive environment. To these solutions were then added sufficient amounts of water-dispersible amine formulation to achieve a level of 500 ppm of the active amine inhibitor. The water-dispersible formulations typically consisted of 20% active amine, 35% decanol, 35% dodecanol and 10% nonionic surfactant. Following addition of the inhibitor, the corrosion rate was monitored and percent inhibition calculated as described above.

In this test, tallowamine provided greater than 95% inhibition for less than three hours, after which time the corrosion rates were above 1000 mpy (less than 90% inhibition). In contrast, the tridecylaniline/formaldehyde oligomer of Example 3 (Table I) provided greater than 98% inhibition for the full 24-hour duration of the test, maintaining the corrosion rate under 200 mpy throughout.

Example 19

Comparison of Formulated Oligomeric Alkylaniline with Commercial Nalco Visco 4907 for $CO_2$ Corrosion Cleaned and degreased mild steel coupons were immersed in a synthetic seawater solution saturated with $CO_2$ gas at 90° C. and equilibrated for 18 hours. The instantaneous general corrosion rates were electrochemically measured using the standard linear polarization method to give the uninhibited corrosion rates for the test coupons, typically 100–150 mpy in this environment. To these solutions were then added sufficient amounts of formulated inhibitor to reach 100 ppm total formulation in the corrosion solution. A comparison was made with Nalco Visco 4907, a commercial nitrogen-containing corrosion inhibitor formulation. The commercial Nalco formulation was used as received. The dodecylaniline/formaldehyde oligomer ($C_{12}$ AFO) of Example 14 (Table III) was used in a formulation consisting of:

| | |
|---|---|
| $C_{12}$ AFO | 25.3% |
| Empol 1024 Dimer/Trimer Acid | 24.7% |
| Nonionic surfactant | 4.0% |
| Kerosene | 42.2% |
| Isopropanol | 3.8% |

The Empol 1024 dimer/trimer acid is a commercially available fatty acid oligomer. The nonionic surfactant used in this formulation was Igepal CO-630, a p-nonylphenyl ethoxylate containing nine ethoxy groups per molecule. Following addition of the formulated inhibitors, the corrosion rate was monitored and the percent inhibition calculated according to the formula shown above.

Both inhibitor formulations quickly lowered the corrosion rate and provided significant inhibition. Following 18 hours, the inhibited corrosion rates had stabilized at 7 mpy for the Nalco formulation and at 3.5 mpy for the formulated $C_{12}$ AFO inhibitor.

Example 20

Comparison of Formulated Oligomeric alkylaniline with Commercial Nalco Visco 4907 for $H_2S$ Corrosion Cleaned and degreased mild steel coupons were immersed in a synthetic seawater solution saturated with $H_2S$ gas at 90° C. and equilibrated for 18 hours. The instantaneous general corrosion rates were electrochemically measured using the standard linear polarization method to give the uninhibited corrosion rates for the test coupons, typically 75–125 mpy in this environment. To these solutions were then added sufficient amounts of formulated inhibitor to reach 100 ppm total formulation in the corrosion solution. The commercial Nalco formulation, Nalco Visco 4907, was used as received. The dodecylaniline/formaldehyde oligomer ($C_{12}$ AFO) of Example 14 (Table III) was used in the same formulation listed in Example 19. Following addition of the formulated inhibitors, the corrosion rate was monitored and the percent inhibition calculated as shown above.

Both inhibitor formulations quickly lowered the corrosion rate and provided significant inhibition. Following 18 hours, the inhibited corrosion rates had stabilized at 21 mpy for the Nalco formulation and at 7 mpy for the formulated $C_{12}$ AFO inhibitor.

What is claimed is:

1. A hydrocarbon-soluble corrosion inhibitor composition comprising the reaction product obtained by the acid-catalyzed oligomerization of (A) an alkylaniline having from 4 to 30 carbon atoms in the alkyl substituent, and (B) formaldehyde.

2. The composition according to claim 1, wherein the alkylaniline has from 10 to 30 carbon atoms in the alkyl substituent.

3. The composition according to claim 2, wherein the alkylaniline has from 12 to 24 carbon atoms in the alkyl substituent.

4. The composition according to claim 3, wherein the alkylaniline is dodecylaniline.

5. The composition according to claim 3, wherein the alkylaniline is ($C_{20-24}$)-alkylaniline.

6. The composition according to claim 1, wherein the molar ratio of formaldehyde to alkylaniline is about 0.8:1 to 4:1.

7. The composition according to claim 6, wherein the molar ratio of formaldehyde to alkylaniline is about 1:1 to 1.8:1.

8. A method of inhibiting corrosion of a corrodible metal material which comprises contacting the metal material with an effective amount of a corrosion inhibitor composition comprising the reaction product obtained by the acid-catalyzed oligomerization of (A) an alkylaniline having from 4 to 30 carbon atoms in the alkyl substituent, and (B) formaldehyde.

9. The method according to claim 8, wherein the alkylaniline has from 10 to 30 carbon atoms in the alkyl substituent.

10. The method according to claim 9, wherein the alkylaniline has from 12 to 24 carbon atoms in the alkyl substituent.

11. The method according to claim 10, wherein the alkylaniline is dodecylaniline.

12. The method according to claim 10, wherein the alkylaniline is ($C_{20-24}$)-alkylaniline.

13. The method according to claim 8, wherein the molar ratio of formaldehyde to alkylaniline is about 0.8:1 to 4:1.

14. The method according to claim 13, wherein the molar ratio of formaldehyde to alkylaniline is about 1:1 to 1.8:1.

15. A method of inhibiting corrosion of a corrodible metal material in or around a well through which a corrosive fluid is produced, which comprises contacting the metal material with an effective amount of a corrosion inhibitor composition comprising the reaction product obtained by the acid-catalyzed oligomerization of (A) an alkylaniline having from 4 to 30 carbon atoms in the alkyl substituent, and (B) formaldehyde.

16. A composition comprising (a) about 15 to 30% of the corrosion inhibitor composition of claim 1;

(b) about 15 to 30% of a dimer/trimer acid;

(c) about 1 to 8% of a nonionic surfactant;

(d) about 4 to 75% of a hydrocarbon solvent; and (e) about 0 to 5% of isopropanol.

* * * * *